US006788305B1

(12) United States Patent
Ohga

(10) Patent No.: US 6,788,305 B1
(45) Date of Patent: Sep. 7, 2004

(54) IMAGE PROCESSING APPARATUS AND METHOD

(76) Inventor: Manabu Ohga, c/o Canon Kabushiki Kaisha, 30-2, Shimomaruko 3-chome, Ohta-ku, Tokyo (JP)

( * ) Notice: Subject to any disclaimer, the term of this patent is extended or adjusted under 35 U.S.C. 154(b) by 0 days.

(21) Appl. No.: 09/358,479

(22) Filed: Jul. 21, 1999

(30) Foreign Application Priority Data

Jul. 24, 1998 (JP) ..... 10-209946

(51) Int. Cl.[7] ..... G09G 5/02
(52) U.S. Cl. ..... 345/589; 358/504
(58) Field of Search ..... 382/167; 358/504; 713/153; 345/600, 603, 589, 595

(56) References Cited

U.S. PATENT DOCUMENTS 6,043,909 A * 3/2000 Holub ..... 358/504
6,151,675 A * 11/2000 Smith ..... 713/153
6,157,735 A * 12/2000 Holub ..... 382/167

* cited by examiner

*Primary Examiner*—Matthew Luu

(57) ABSTRACT

There is a method of executing color matching for image data obtained via a network using a profile of an input device embedded in image data received from a server, a profile of an output device selected by the user, and a color matching module (CMM) of the client. This processing method is suitable for distributed processing since the load on the server is light. However, since the CMM of the client is used, different color matching results may be obtained if clients use different CMMs. Furthermore, when the user has no CMM, color matching cannot be done. Hence, upon downloading an HTML document on the server designated by the user, the HTML document is interpreted by a WWW browser, and when the HTML document contains a link for downloading a CMM program, the CMM program is downloaded via the network.

13 Claims, 8 Drawing Sheets

IMAGE PROCESSING APPARATUS AND METHOD

BACKGROUND OF THE INVENTION

1. Field of the Invention

The present invention relates to an image processing apparatus and method and, more particularly, to an image processing apparatus and method that attain color matching in correspondence with the environment light.

2. Description of the Related Art

As the methods for performing color matching of image data obtained via a network, the following methods may be used.

(1) When client executes color matching: As shown in FIG. 1, image data embedded with a profile of an input device is received from a server, and color matching is done for image data obtained via the network using the embedded profile, a profile of an output device selected by the user, and a color matching module (CMM) of the client.

(2) When server executes color matching: As shown in FIG. 2, color matching is done for image data to be sent to a client using a profile of an output device sent from the client, a profile of a device that inputs the image data, and a CMM of the server.

Processing method (1) is suitable for distributed processing since the server's load is light. However, since the CMM of the client is used, different color matching results may be obtained if different CMMs are used depending on clients. Furthermore, when a client has no CMM, color matching cannot be done.

Processing method (2) can avoid these problems, i.e., color matching results are different depending on clients or color matching cannot be done, since the CMM of the server is used. However, when color matching is done for image data with high resolution or when access that pertains to color matching occurs frequently, the server's response may be worsened.

SUMMARY OF THE INVENTION

It is an object of the present invention to provide an image processing apparatus and method which can execute appropriate color matching in a network environment.

In order to achieve the above object, one preferred embodiment of the present invention discloses an image processing apparatus used on a network environment, comprising: acquisition means for acquiring a color matching module via the network; and processing means for executing color matching using the acquired color matching module.

Also, the present invention discloses an image processing method used by an image processing apparatus which is used on a network environment, said method comprising the steps of: acquiring a color matching module via the network; and executing color matching using the acquired color matching module.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

A preferred embodiment of an image processing apparatus and method according to the present invention will be described in detail hereinafter with reference to the accompanying drawings.

A case will be explained below wherein a CMM program has an intermediate code format.

Figure 1:
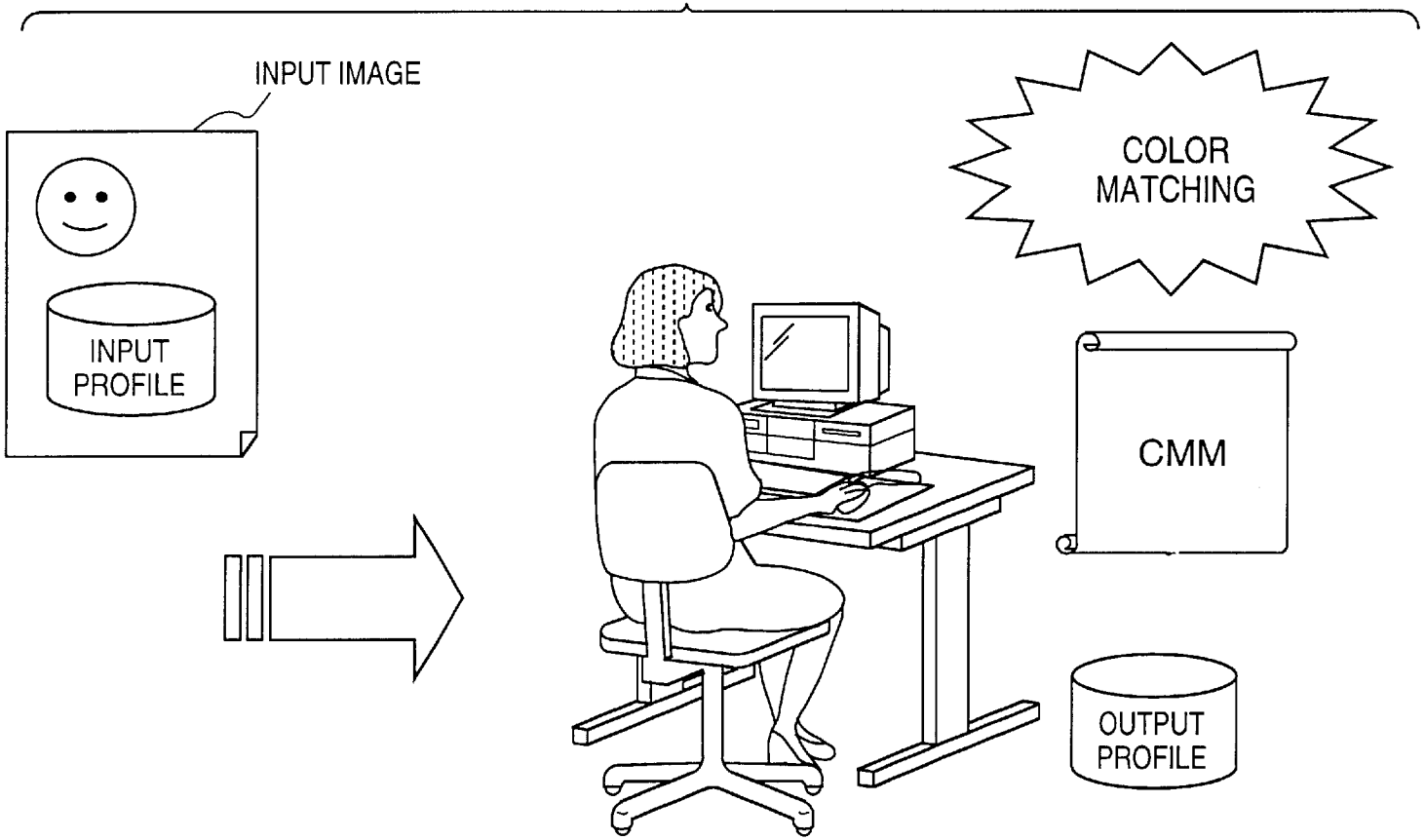
FIG. 1 is a view for explaining a method of performing color matching for image data obtained via a network.
Figure 2:
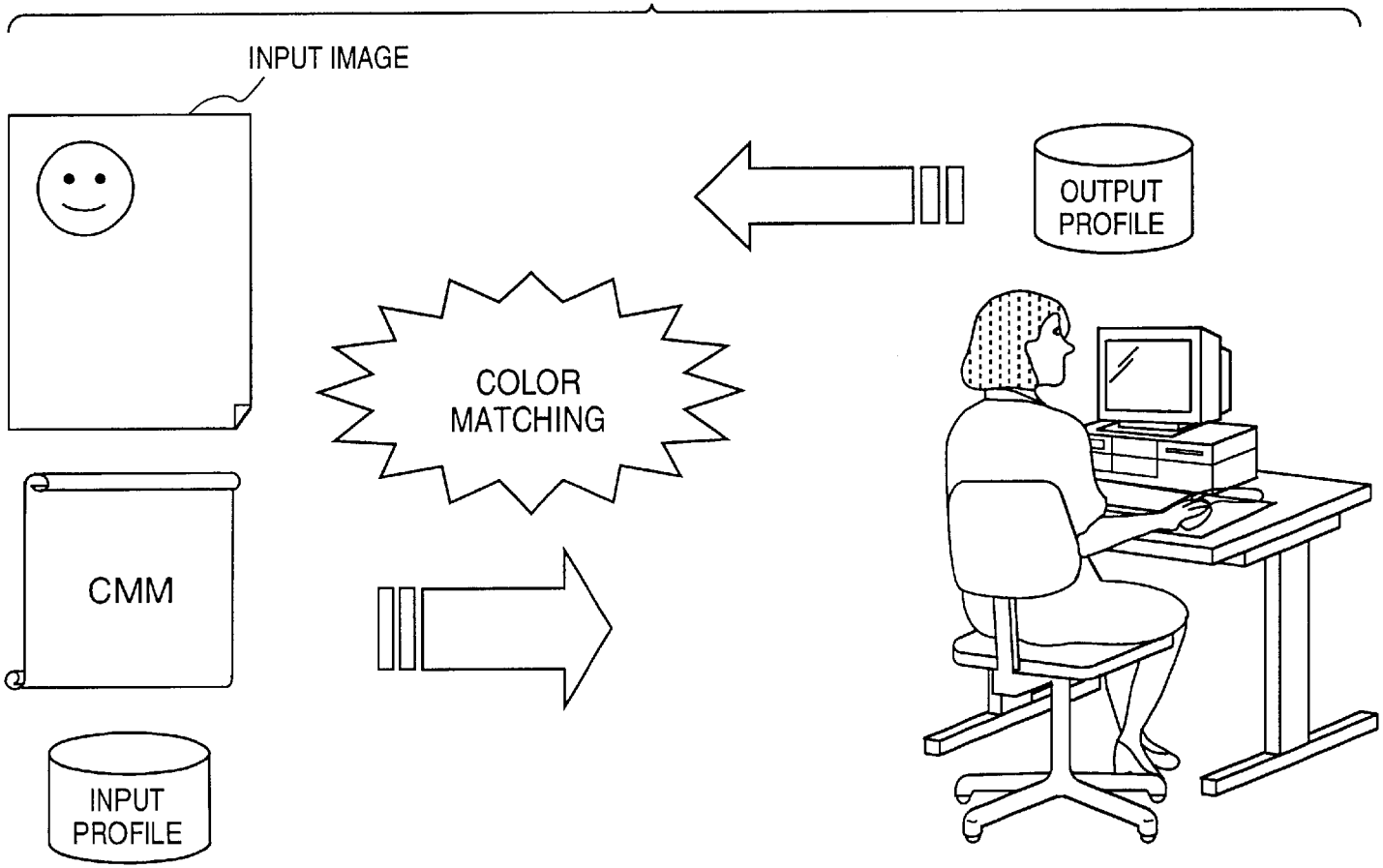
FIG. 2 is a view for explaining another method of performing color matching for image data obtained via a network.
Figure 3:
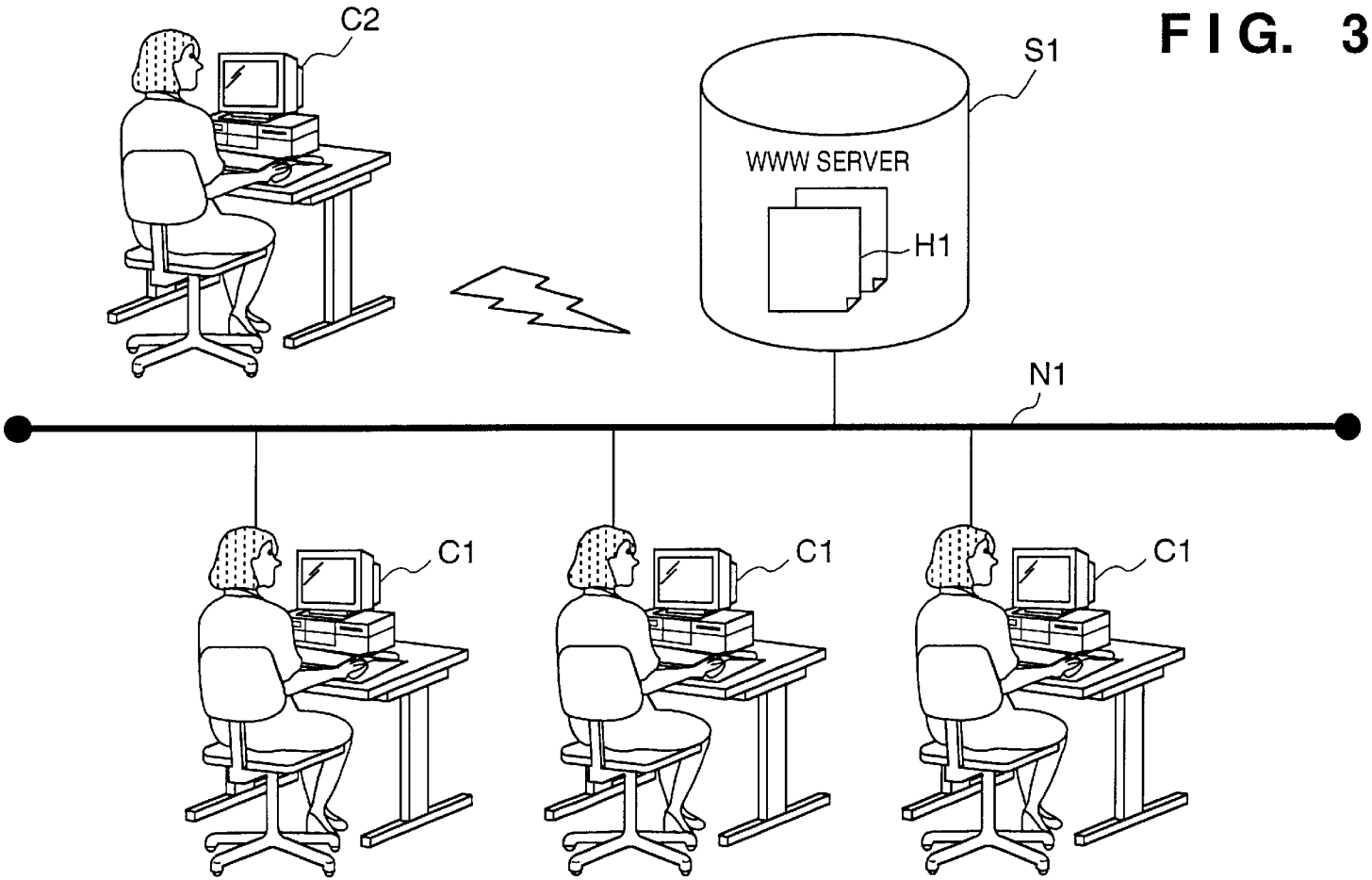
FIG. 3 is a diagram showing a network environment in an embodiment according to the present invention.

FIG. 3 shows a network environment in this embodiment. A World Wide Web (WWW) server S1 is running on a computer which is connected to a network N1 such as Ethernet, Fiber Distributed Data Interface (FDDI), or the like. The WWW server S1 has a Hyper Text Markup Language (HTML) document H1, which is set with a link to an image data file. Note that the storage location of the image data file linked to the HTML document may be the WWW server S1, but the image data file may be stored in any other computers as long as they can be linked.

A WWW browser C1 is running on a computer connected to the network N1. Also, a WWW browser C2 is running on a computer, which is connected to the WWW server S1 via a communication device such as a MODEM, terminal adapter (TA), or the like.

Figure 8:
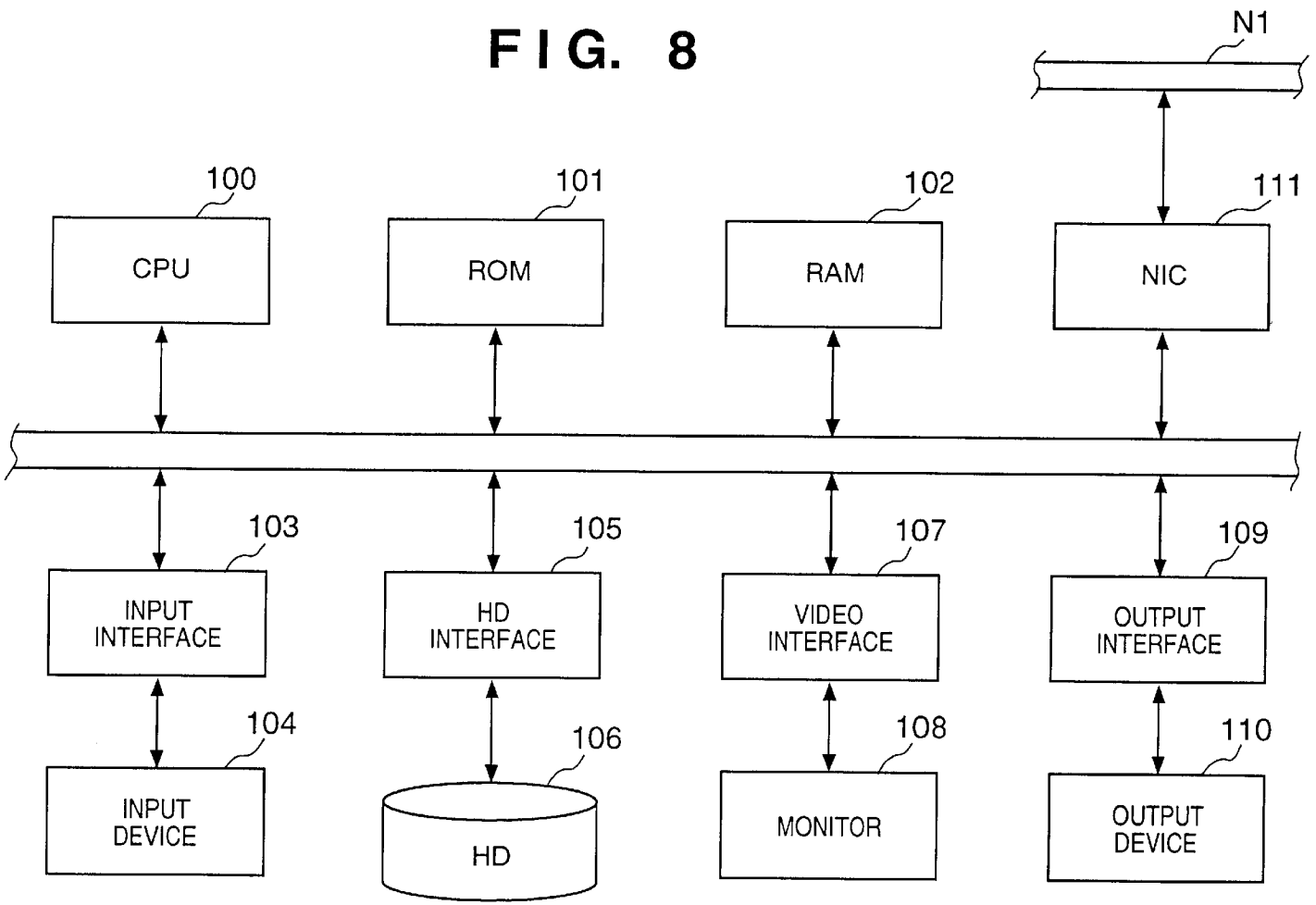
FIG. 8 is a block diagram showing the arrangement of a client computer.

FIG. 8 is a block diagram showing the arrangement of a client computer. The apparatus shown in FIG. 8 is implemented by a versatile computer apparatus such as a personal computer and the like.

Referring to FIG. 8, a CPU 100 controls the overall apparatus in accordance with a program stored in a ROM 101, hard disk (HD) 106, and the like using a RAM 102 as a work memory, and executes various kinds of processes such as a process that pertains to color matching. An input interface 103, hard disk interface 105, video interface 107, and output interface 109 are interfaces for respectively connecting an input device 104, the HD 106, a monitor 108, and an output device 110. A network interface card (NIC) 111 is an interface card for connecting the apparatus of this embodiment to the network N1.

Note that the input device 104 includes image sensing devices such as a digital still camera, digital video camera, and the like, and various image input devices such as image readers, e.g., an image scanner, film scanner, and the like. The output device 110 includes color monitors such as a CRT, LCD, and the like, and image output devices such as a color printer, film recorder, and the like.

Images and videos captured by these image sensing devices and image input devices can be stored in the server S1 via the network N1 together with input profiles of these devices. Also, HTML documents created using devices (not shown) such as a keyboard, mouse, and the like connected to the apparatus shown in FIG. 8 can be stored in the server S1. Note that the arrangement of the server S1 is nearly the same as that of the client computer shown in FIG. 8.

Figure 4:
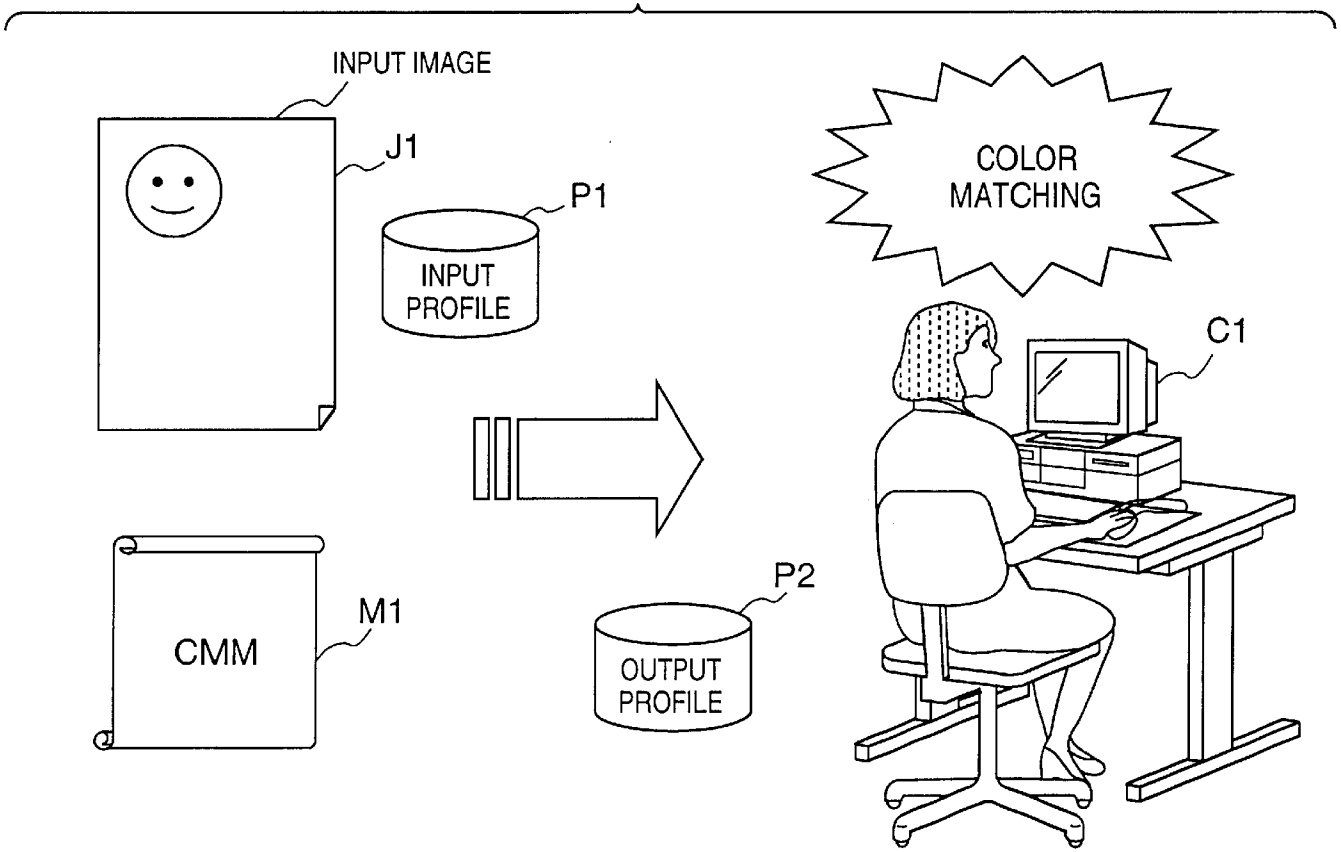
FIG. 4 is a view for explaining the flow of data in the embodiment.

FIG. 4 is a view for explaining the flow of data in this embodiment. Reference symbol J1 denotes, e.g., image data stored in the WWW server S1. The image data S1 is image data in a color space such as RGB, CMY, CMYK, or the like, or a device-independent color space such as CIE XYZ, Lab, Lub, or the like, which is input by an input device such as a digital still camera, digital video camera, image scanner, film scanner, or the like. An input profile P1 of the device that inputs the image data J1 is also stored in, e.g., the WWW server S1.

Reference symbol M1 denotes a CMM program stored in the WWW server S1; and P2, a profile of an output device stored in a computer on which the WWW browser C1 is running.

Figure 5:
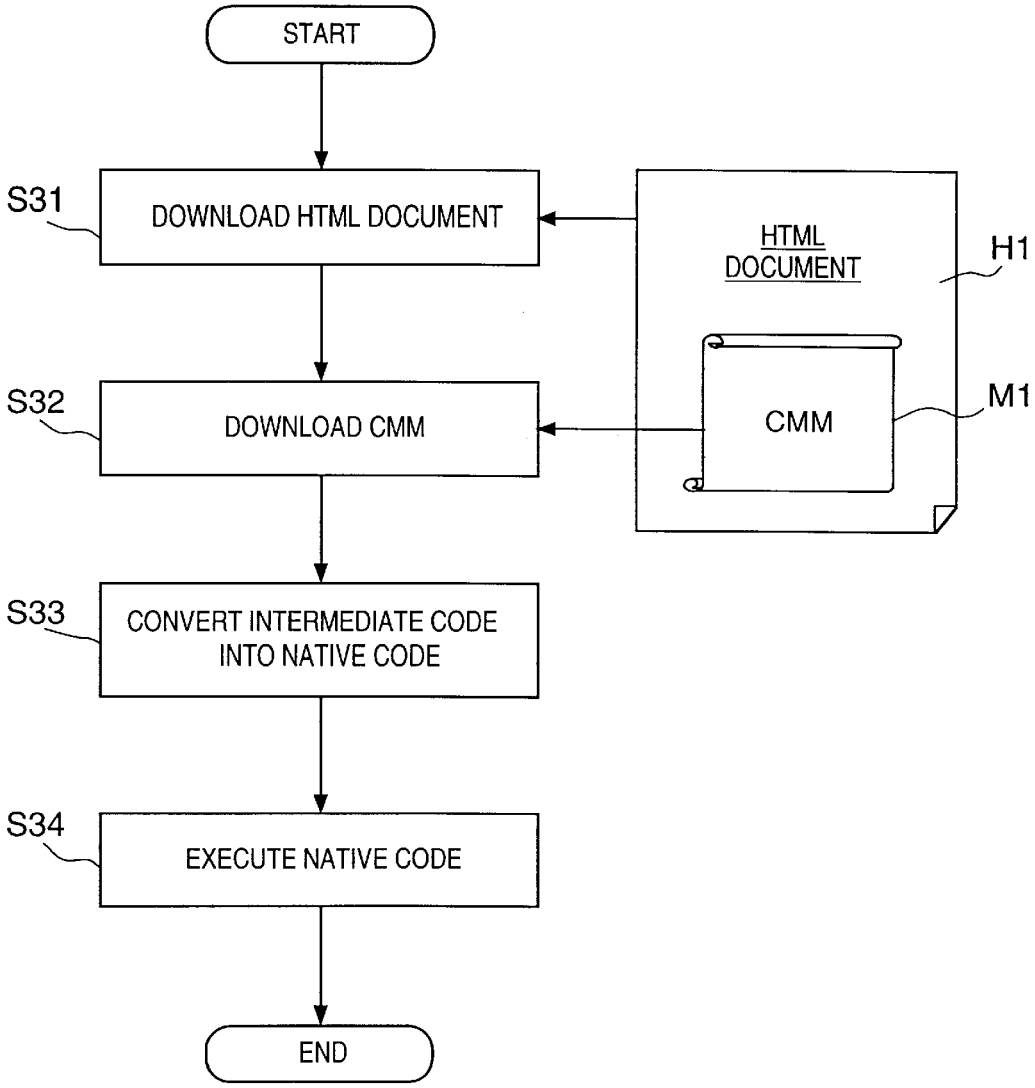
FIG. 5 is a flow chart for explaining the processes of the embodiment.
Figure 6:
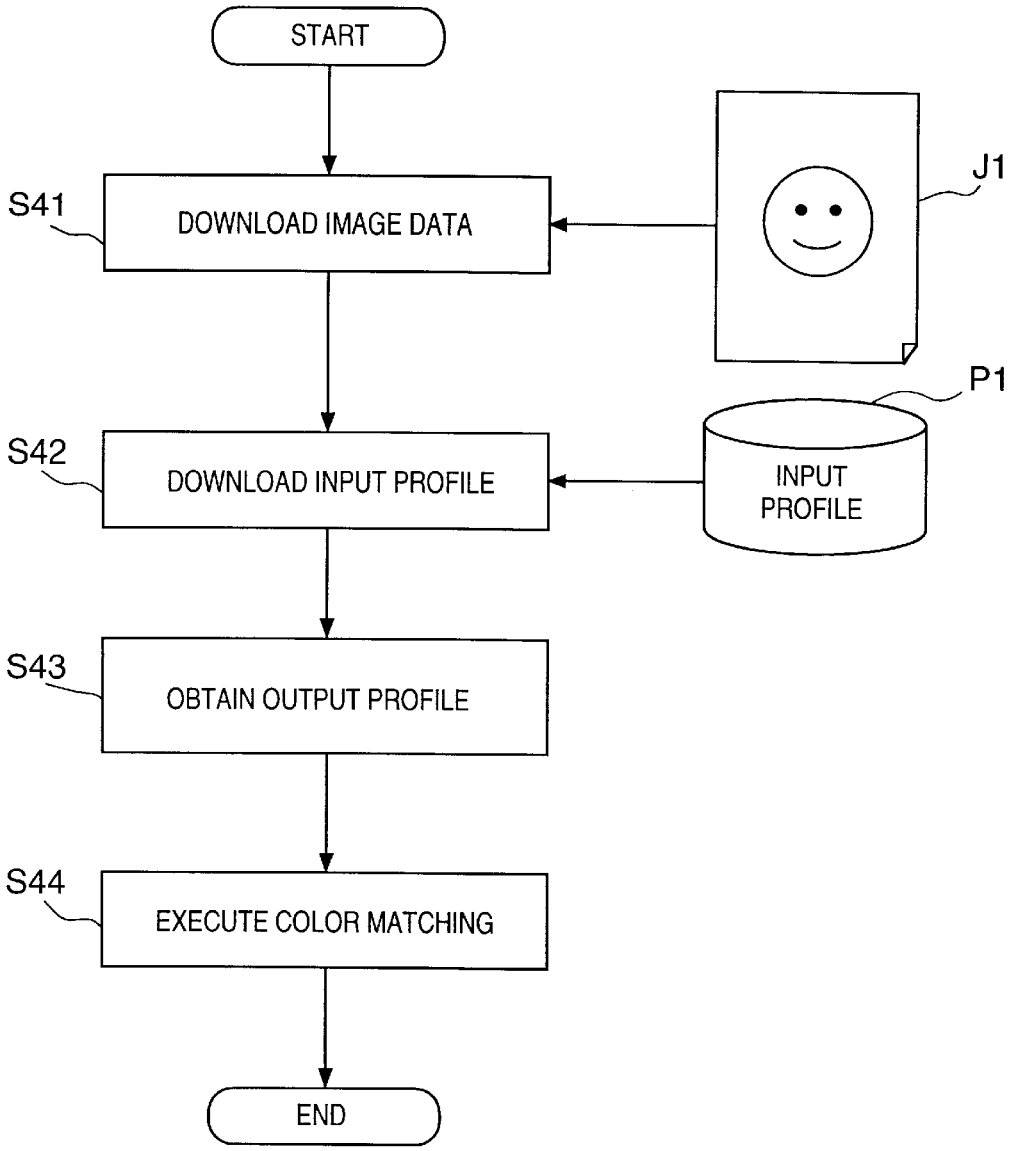
FIG. 6 is a flow chart for explaining the processes of the embodiment.

FIGS. 5 and 6 are flow charts for explaining the processes of this embodiment, which are executed by the client computer.

In step S31 in FIG. 5, the HTML document H1 in the WWW server S1, which is designated by the user, is downloaded. The downloaded HTML document H1 is interpreted by the WWW browser C1. When the HTML document H1 contains a file link for downloading the CMM program M1, the CMM program M1 is downloaded in step S32.

Since the downloaded CMM program M1 is described in an intermediate code format, which is independent of any specific CPUs, operating systems (OSs), and the like, the program M1 is converted from the intermediate code format into a native code format which depends on the OS or CPU of the client in step S33. In step S34, the CMM program M1 converted into the native code format is executed.

In step S41, the image data J1 is downloaded based on the set link. The input profile P1 which is associated with the image data J1 is downloaded in step S42. Note that the input profile P1 on the WWW server S1 is stated in advance in the HTML document H1, and is passed as a parameter to the CMM program M1. More specifically, a designated one of a plurality of profiles on the WWW server S1 is downloaded in accordance with the designation of the input profile on the HTML document H1 in step S42. The format of the profile matches or complies with that specified by International Color Consortium (ICC).

In step S43, a profile of, e.g., a monitor connected to the client computer is acquired by one of the following methods. The obtained profile is passed to the CMM program M1.

(1) A plurality of pieces of information (e.g., names or symbols) of monitor profiles prepared in the server are presented to the user, and the monitor profile selected by the user is downloaded from the server. The profile names presented to the user, and profiles on the server are associated with each other in advance, and when the user selects a given profile name, the corresponding profile on the server is automatically loaded into the CMM program of the client. On the other hand, the CMM program may have a plurality of monitor profiles, and one of them may be selected by the user.

(2) The user is prompted to input or designate color space characteristics, i.e., the XYZ values of RGB primary colors, gamma coefficient, and XYZ value of white point, and a monitor profile is created based on these data.

(3) The user is prompted to designate a profile stored in the client computer.

(4) A monitor profile that defines standard monitor characteristics such as sRGB or the like is used as a default.

In step S44, the CMM program M1 executes color matching for the image data J1 on the basis of the input profile P1 and monitor profile. The image data J1 that has undergone color matching is sent to the monitor, and an image is displayed. Note that the output destination of the image data J1 that has undergone color matching is not limited to the monitor. For example, the image data J1 may be output to an image output device such as a printer, film recorder, or the like. In this case, the profile of such image output device is used in place of the monitor profile.

In the above embodiment, the CMM program M1 is described in the intermediate code format. Alternatively, the CMM program M1 may be described in a format depending on the CPU or OS, e.g., in the native code format. Especially, when the processing speed is of primary importance, the native code format is preferably used. When the CMM program M1 is described in the native code format, CMM programs described in a plurality of different native code formats are prepared in advance on the server in correspondence with operation environments. In step S32 in FIG. 5, a native code format that the client can execute is selected on the basis of the recognized operation environment of the client, and a CMM program described in that native code format is downloaded. Hence, the control passes through the process in step S33 of converting the CMM program from the intermediate code format into the native code format.

Figure 7:
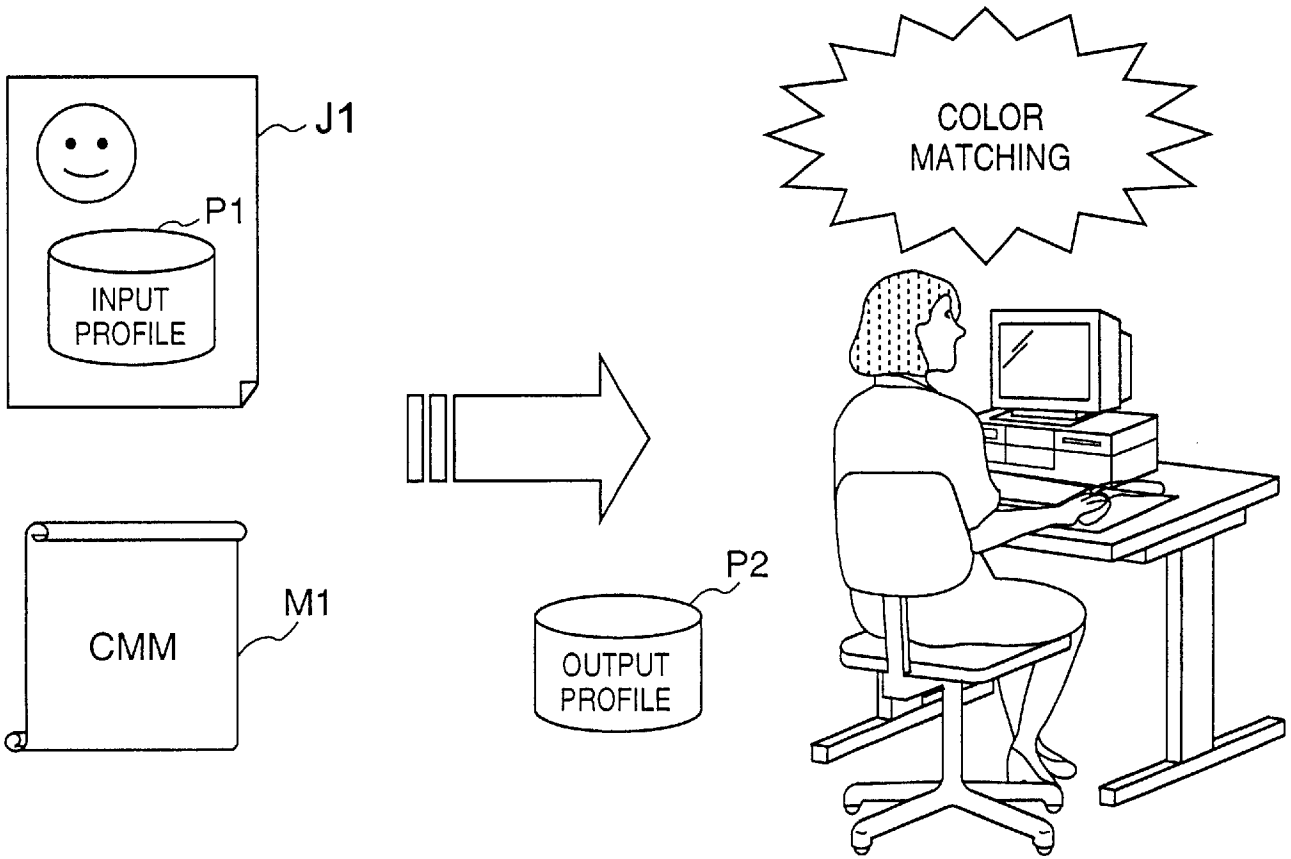
FIG. 7 is a view for explaining a case wherein an input profile is embedded in image data.

In the aforementioned embodiment, the input profile P1 is stored in the WWW server S1. As shown in FIG. 7, the input profile P1 may be embedded in the image data J1. Especially, when image data are stored in a large number of servers, input profiles are preferably embedded in them. In this case, the process in step S42 shown in FIG. 6 demultiplexes the input profile from the downloaded image data, and the CMM program may have such demultiplex process.

As described above, according to this embodiment, the following effects can be obtained.

(1) When the client executes a CMM program downloaded from the server, the load on the entire network can be distributed, and use efficiency of the entire network can be improved.

(2) When the CMM program is provided in the intermediate code format which is independent of CPUs, OSs, and the like, client computers having different CPUs or OSs can obtain identical color matching results. Conversely, when the CMM program in the native code format is provided, the processing speed can be improved.

To restate, according to the present invention, an image processing apparatus and method which can execute appropriate color matching in a network environment can be provided.

Modifications of Embodiment

[First Modification: For Multiple Images]

A plurality of images are displayed on one frame in some cases, but profiles corresponding to these images are not always the same. Thus, a procedure corresponding to a modification of FIG. 6 for efficiently downloading profiles corresponding to a plurality of images will be explained below.

In this modification, a list of profiles required for a plurality of images that belong to one frame and are downloaded in step S41 in FIG. 6 is prepared, and the profiles are downloaded from the server on the basis of the prepared profile list in step S42.

This profile list is prepared based on profile information designated for each image, which is extracted from an HTML document script that describes the configuration of the frame to which a plurality of images belongs.

On the other hand, when the client computer has a function of caching profiles, a profile list from which already cached profiles are excluded is prepared again. Profiles are then downloaded from the server on the basis of the created profile in step S42. Note that the cache is a function of automatically saving downloaded profiles.

Upon caching profiles, when a plurality of frames are displayed in turn, a large number of profiles are cached and consume a large memory area. Hence, the number of profiles to be cached or the memory size assigned to profile cashing is preferably limited. When the number of profiles or the assigned memory size has reached a limit, cached profiles are deleted in the cached order or in the order the profile was used.

Furthermore, when a plurality of images are displayed on one frame, if images that use an identical profile successively undergo color matching in step S44, the number of times of initialization required for color matching can be reduced. Hence, processes for the entire frame can be efficiently done, and the time required for color matching can be reduced.

This process can be easily implemented by grouping images on the basis of the discrimination results of profiles of images upon preparing for the profile list. That is, images that use identical profiles are grouped on the basis of the discrimination results of profiles of a plurality of images that belong to one frame, and the order of color matching can be controlled based on these groups.

[Second Modification: Control of Color Matching]

An HTML document can designate the display size of an image. When the display size is designated, that image is displayed in a reduced (or enlarged) scale on the screen on the basis of the designated size and an image size recorded in header information of image data.

The image displayed in a reduced size can be displayed at an equal magnification on the basis of the user's instruction.

In case of an image displayed in a reduced scale, since pixels are decimated, the color tone of an original image can hardly be reproduced. Hence, there is no merit to apply color matching to a reduced-scale image or an image displayed in a reduced scale. For this reason, no color matching is done for a reduced-scale image, and only when an equal-magnification image is displayed, i.e., when an HTML document designates an equal-magnification display or when the user designates an equal-magnification display, control is made to apply color matching.

The color matching control can be easily implemented by controlling an image to be subjected color matching in step S44 on the basis of the size information of image data downloaded in step S41.

When color matching is controlled, if there is no merit to apply color matching, color matching is automatically disabled. Therefore, the processing time can be shortened without any image quality drop of an output image.

Or when an image is displayed on the screen, a button for turning on/off execution of color matching of that image may be displayed beside the displayed image, and the user may manually control color matching.

In this manner, color matching can be controlled according to user's will and/or image application.

As many apparently widely different embodiments of the present invention can be made without departing from the spirit and scope thereof, it is to be understood that the invention is not limited to the specific embodiments thereof except as defined in the appended claims.

What is claimed is:

1. An image processing apparatus for processing document data, which is downloaded via a network and which is set with an image link to image data, comprising:

an obtaining unit, arranged to download the document data from a server on the network;

a download unit, arranged to download a program of a color matching module, based on a file link included in the downloaded document data for downloading the program of the color matching module, to download the image data, based on the image link included in the downloaded document data, and to download an input profile linked to the image data, via the network;

an acquisition unit, arranged to acquire an output profile; and a processor, arranged to execute a color matching process on the downloaded image data using the input and output profiles under control of the downloaded program of the color matching module.

2. The apparatus according to claim 1, wherein the document data is an HTML document.

3. The apparatus according to claim 1, wherein the program of the color matching module is described in an intermediate code format.

4. The apparatus according to claim 3, further comprising a translation unit, arranged to translate the program of the color matching module described in the intermediate code format into a native code format depending on an operating system or a microprocessor of said apparatus.

5. An image processing method of processing document data, which is downloaded via a network and which is set with an image link to image data, said method comprising the steps of:

downloading the document data from a server on the network;

downloading a program of a color matching module, based on a file link included in the downloaded document data for downloading it, via the network;

downloading the image data, based on the image link included in the downloaded document data via the network;

downloading an input profile linked to the image data, via the network;

acquiring an output profile; and executing a color matching process on the downloaded image data using the input and output profiles acquired profile under control of the downloaded program of the color matching module.

6. The method according to claim 5, wherein the document data is an HTML document.

7. The method according to claim 5, wherein the program of the color matching module is described in an intermediate code format.

8. The method according to claim 7, further comprising the step of translating the program of the color matching module described in the intermediate code format into a native code format depending on an operating system or a microprocessor of an apparatus in which said image processing method is executed.

9. A computer program for implementing an image processing method of processing document data, which is downloaded via a network and which is set with an image link to image data, said program comprising:

code for downloading the document data from a server on the network;

code for downloading a program of a color matching module, based on a file link included in the downloaded document data for downloading the program of the color matching module, via the network;

code for downloading the image data, based on the image link included in the downloaded document data, via the network;

code for downloading an input profile linked to the image data, via the network;

code for acquiring an output profile; and code for executing a color matching process on the downloaded image data using the input and output profiles under control of the downloaded program of the color matching module.

10. The method according to claim 5, wherein the color matching process is executed using the input profile related to the image data and the output profile related to a monitor connected to an apparatus in which said image processing method is executed, and wherein the step of downloading the image data includes the steps of:

determining the input profile of each of a plurality image data linked to the downloaded document data;

generating a profile list of determined input profiles; and downloading the input profile based on the profile list.

11. An image processing method of processing document data, which is downloaded via a network and which is set with an image link to image data, said method comprising the steps of:

downloading a color matching module, based on a file link included in the document data for downloading it, via the network;

downloading the image data, based on the image link included in the document data, via the network; and executing a color matching process on the downloaded image data using the downloaded color matching module and outputting the processed image data to an image output device, wherein the color matching process is executed using a source profile related to the image data and a monitor profile related to a monitor connected to an apparatus in which said image processing method is executed, and when the document data links to a plurality of image data, image data relating to a same source profile are subjected to the color matching process in series.

12. An image processing method of processing document data, which is downloaded via a network and which is set with an image link to image data, said method comprising the steps of:

downloading a color matching module, based on a file link included in the document data for downloading it, via the network;

downloading the image data, based on the image link included in the document data, via the network;

executing a color matching process on the downloaded image data using the downloaded color matching module;

reducing an image size of the downloaded image data;

controlling whether the reduced image data is subjected to the color matching process or not; and outputting the reduced image data to an image output device.

13. The method according to claim 5, further comprising the step of controlling operation of said executing step in accordance with a user instruction.

* * * * *

UNITED STATES PATENT AND TRADEMARK OFFICE

CERTIFICATE OF CORRECTION

PATENT NO. : 6,788,305 B1
DATED : September 7, 2004
INVENTOR(S) : Manabu Ohga

It is certified that error appears in the above-identified patent and that said Letters Patent is hereby corrected as shown below:

Title page,
Item [76], Inventor, "Manabu Ohga, c/o Canon Kabushiki Kaisha, 30-2, Shimomaruko 3-chome, Ohta-ku, Tokyo (JP)" should read -- Manabu Ohga, Yokohama (JP) --.
Insert Item: -- [73] Assignee: Canon Kabushiki Kaisha, Tokyo, Japan --.
Insert Item: -- [74] *Attorney, Agent, or Firm*: Fitzpatrick, Cella, Harper & Scinto --.

Column 4,
Line 2, "sRGB" should read -- RBGs --.

Column 5,
Line 52, "subjected" should read -- subjected to --.

Column 6,
Line 50, "acquired" should be deleted.
Line 51, "profile" should be deleted.

Signed and Sealed this

Eighteenth Day of October, 2005

JON W. DUDAS
*Director of the United States Patent and Trademark Office*